US006247758B1

(12) United States Patent
Schüpphaus

(10) Patent No.: US 6,247,758 B1
(45) Date of Patent: Jun. 19, 2001

(54) LONGWALL COAL CUTTER AND LOADER

(75) Inventor: Herbert Schüpphaus, Bochum (DE)

(73) Assignee: Eickhoff Maschinenfabrik GmbH, Bochum (DE)

( * ) Notice: Subject to any disclaimer, the term of this patent is extended or adjusted under 35 U.S.C. 154(b) by 0 days.

(21) Appl. No.: 09/434,581

(22) Filed: Nov. 4, 1999

(51) Int. Cl.[7] ..... E21C 35/20
(52) U.S. Cl. ..... 299/43; 299/85.1
(58) Field of Search ..... 299/85.1, 42, 43, 299/44, 51, 53

(56) References Cited

U.S. PATENT DOCUMENTS

| | | | |
|---|---|---|---|
| Re. 28,741 | 3/1976 | Delli-Gatti, Jr. | 299/68 |
| 2,595,398 | 5/1952 | Lewis | 299/65 |
| 3,945,680 | 3/1976 | Henrich et al. | 299/43 |
| 4,155,598 | 5/1979 | Parrot et al. | 299/43 |
| 4,449,755 | 5/1984 | Nelson | 299/31 |
| 4,465,319 | 8/1984 | Brownlie | 299/42 |
| 5,730,501 | 3/1998 | Grathoff et al. | 299/39.2 |

FOREIGN PATENT DOCUMENTS

| | | | |
|---|---|---|---|
| 2220017 | 12/1989 | (GB) | 299/42 |

*Primary Examiner*—David Bagnell
*Assistant Examiner*—Sunil Singh
(74) *Attorney, Agent, or Firm*—Collard & Roe, P.C.

(57) ABSTRACT

A longwall coal cutter and loader for longwall mining operations has a machine body drivable along a longwall conveyor in the longitudinal direction of the longwall surface, and at least two cutting rollers complementing or overlapping each other with their cutting sections. In order to improve the transverse transport of the mined material onto the longwall conveyor, to optimize the arrangement of the cutting tools on the cutting rollers in view of the cutting action, a horizontal roller is provided for cutting free the roof. The horizontal roller has a rotary axle extending parallel with the roof and cooperates with a vertical roller for cutting free the sill, the vertical roller having a rotary axle extending perpendicular to the sill. The horizontal roller is arranged above the vertical roller and leads the vertical roller in the direction of travel in the mining operation.

10 Claims, 2 Drawing Sheets

LONGWALL COAL CUTTER AND LOADER

BACKGROUND OF THE INVENTION

1. Field of the Invention

The present invention relates to a longwall coal cutting and loading machine for mining coal in longwalling operations, with a machine body which is drivable along a longwall coal conveyor in the longitudinal direction of the longwall working operation, and with at least two cutting rollers complementing or overlapping each other with their cutting sections.

2. The Prior Art

Longwall coal cutters and loaders are, in most cases, equipped with two horizontal rollers. The axes of rotation of the rollers extend parallel with the roof and perpendicular to the surface being worked, whereby the cutting sections of the cutting rollers, which are arranged one after the other in the working direction of the machine, complement or overlap one another in a way such that the material being mined is collected as the longwall cutter and loader is passing through.

The material cut loose is transferred onto a longwall conveyor for transverse conveyance. The longwall conveyor extends parallel with the traveling direction. The transverse conveyance of the material cut loose often has a hampering effect on the efficiency of such roller-equipped longwall coal cutting and loading machines because for such cross conveyance or transfer, a component of movement extending transversely to the driving direction of the mining machine has to be forced upon the material cut loose. For this purpose, the cutting tools are usually arranged on the circumference of the cutting rollers on helically extending, thread-like elements, which are intended to impart onto the material cut loose the required component of movement in the direction of the conveyor. In addition, it is customary in many cases to arrange a broaching plate or a loading chute behind the cutting roller (viewed in the direction of travel); however, such supplemental equipment is often overloaded.

With cutting rollers designed with cutting tools arranged on helical thread-like elements it is not possible to select an optimal arrangement of the cutting tools in view of the cutting process, because it is always necessary to find a compromise that ensures, on the one hand, that the material being mined is cut loose, and adequate transverse conveyance, on the other.

If the cutting tools nonetheless are to be arranged in an optimal way in view of cutting loose the material being mined, it is known in the prior art to arrange behind the cutting roller (again viewed in the direction of travel) separate transverse conveyors, for example in the form of conveyor belts, chain conveyors or similar equipment, which actively take over the required crosswise transport of the material being mined. However, such additional conveying equipment is very complicated and costly, and makes the roller-equipped cutting and loading machine susceptible to trouble accordingly.

According to the state of the art, longwall coal cutting and loading machines with vertically arranged cutting rollers are known as well, especially in Eastern Europe. The axes of rotation of the cutting rollers extend perpendicular to the roof or floor. With such vertical rollers, the bits can be arranged without taking into account in any special way the transverse conveyance because the cutting tools, when operating, generate a throwing motion in the direction of the longwall conveyor. These longwall cutters and loaders with vertical rollers, however, failed to gain wide acceptance in practical life because in spite of numerous technical tests, it has not been possible with satisfactory results to cut free, in a reliable and operationally safe way, the supporting arm carrying the vertical roller and housing the gearing required for driving the vertical roller. Within the range of the supporting arm, an uncollected strip of the material being mined is consequently left behind and obstructs the work of this longwall coal cutting and loading machine.

SUMMARY OF THE INVENTION

Therefore, the problem addressed by the invention is to provide a longwall coal cutter and loader on which the arrangement of the cutting tools on the cutting rollers can be optimized in view of cutting the material loose without having to depend on a separate transverse conveyor, and without leaving behind any material that has to be cut loose on the surface.

The object of the invention is a roller-equipped longwall coal cutter and loader for longwalling mining operations, with a machine body drivable along a longwall conveyor in the longitudinal direction of the longwall, and with at least two cutting rollers complementing or overlapping one another with their cutting sections. The device has a horizontal roller for cutting the roof of the seam loose, with its axis of rotation extending parallel with the roof, which cooperates with a vertical roller for cutting free the sill or floor of the seam, with its axis of rotation extending perpendicular to the sill. The horizontal roller is arranged above the vertical roller and, viewed in the direction of the travel of the machine, ahead of the vertical roller.

With the longwall coal cutter and loader as defined by the invention, the horizontal roller, which is the leading roller in the direction of travel of the machine, first cuts and breaks into the surface in the known way exposing the roof of the seam. In this process, the material cut loose by the leading horizontal roller drops onto the trailing vertical roller below. The vertical roller, by its rotational motion, provides the material being mined with a component of motion in the direction of the longwall conveyor. At the same time, the vertical roller cuts the material loose down to the sill of the seam. During this entire process, the supporting arm carrying the vertical roller is present in the space cut free by the leading horizontal roller, so that unlike the prior art, the supporting arm cannot obstruct the mining work. Of course, the cutting tools can be arranged both on the horizontal and the vertical roller in such a way that the material being mined is cut loose in an optimal manner. In contrast to the prior art, it is basically not necessary any longer to take into account the transverse transport of the material. By virtue of the proposed combination of a horizontal roller and a vertical roller as defined by the invention, the two rollers complement each other with respect to their functions in such a way that the advantages of the different arrangements come fully to bear, and the drawbacks are eliminated.

According to an advantageous further development of the invention, the horizontal roller and the vertical roller as well as their drive motors and gearings are mounted on a common support construction. This arrangement results in a particularly compact type of construction for this novel cutting roller combination including the drive.

So that the longwall coal cutter and loader can be adapted to different sizes or thicknesses of a seam, the horizontal roller and/or the vertical roller can be mounted at different vertical levels with respect to the supporting construction. By fixing the rollers at different vertical levels it is possible to set the range of overlap of the two cutting sections in different ways, so that different overall thicknesses of a seam can be cut free. The greatest possible thickness is reached when the two cutting sections still barely touch each other.

So as to be able to adapt the machine in the course of the mining operation to a deviating course of the seam being mined, if necessary, the supporting construction in its totality may be vertically adjustable with respect to the body of the machine. In this way, the zone cut free by the longwall cutter and loader can be raised or lowered, following the course of the seam as required. The desired vertical adjustability is realized optimally by swivel-mounting the common support construction on the body of the machine in such a way that it is capable of pivoting about an axis of swivel extending perpendicular to the surface of the seam being mined. A hydraulic cylinder is usefully employed for such swivel, the cylinder being arranged between the body of the machine and the common support construction. By retracting and extending the hydraulic cylinder, the common support construction of the horizontal and vertical rollers can be lifted and lowered in the simplest manner.

So that the zone cut free can be adapted to different seam thicknesses in the course of the longwalling work, if need be, the horizontal roller may be supported on the free end of a support arm extending in the direction of travel of the machine, the support arm being pivotally-mounted on the common support construction. It is possible in this way to adapt the relative position of the two cutting rollers relative to one another, and thus the zone cut free, to the thickness of the seam.

In order to improve the transverse conveyance of the material being mined in the direction of the longwall conveyor, the body of the vertical roller may be provided with radially extending driver bridges for the transverse transport of the material detached by the horizontal roller. The driving bridges are usefully located within the zone of the surface sides of the vertical roller, and seize the material cut loose by the horizontal roller in order to throw it onto the longwall conveyor.

Furthermore, it is useful to arrange a broaching plow behind the vertical roller viewed in the direction of mining. The broaching plow pushes the material left behind after the vertical roller onto the conveyor.

For a particularly efficient longwall cutter and loader, a horizontal and vertical roller combination may be provided at each end of the body of the machine for both directions of travel. The otherwise required "empty" runs of the machine are eliminated in this way.

Finally, the axle of the horizontal roller may extend at an angle inclined relative to the surface. This permits supporting the horizontal roller at both of its ends, so that the bearing usually employed only on one side of the horizontal roller can be omitted.

Additional details of the invention are contained in the following detailed description and the attached drawings in which preferred embodiments are illustrated by way of example.

BRIEF DESCRIPTION OF THE DRAWINGS

Other objects and features of the present invention will become apparent from the following detailed description considered in conjunction with the accompanying drawings. It should be understood, however, that the drawings are designed for the purpose of illustration only and not as a definition of the limits of the invention.

In the drawings, wherein similar reference characters denote similar elements throughout the several views.

DETAILED DESCRIPTION OF PREFERRED EMBODIMENTS

Figure 1:
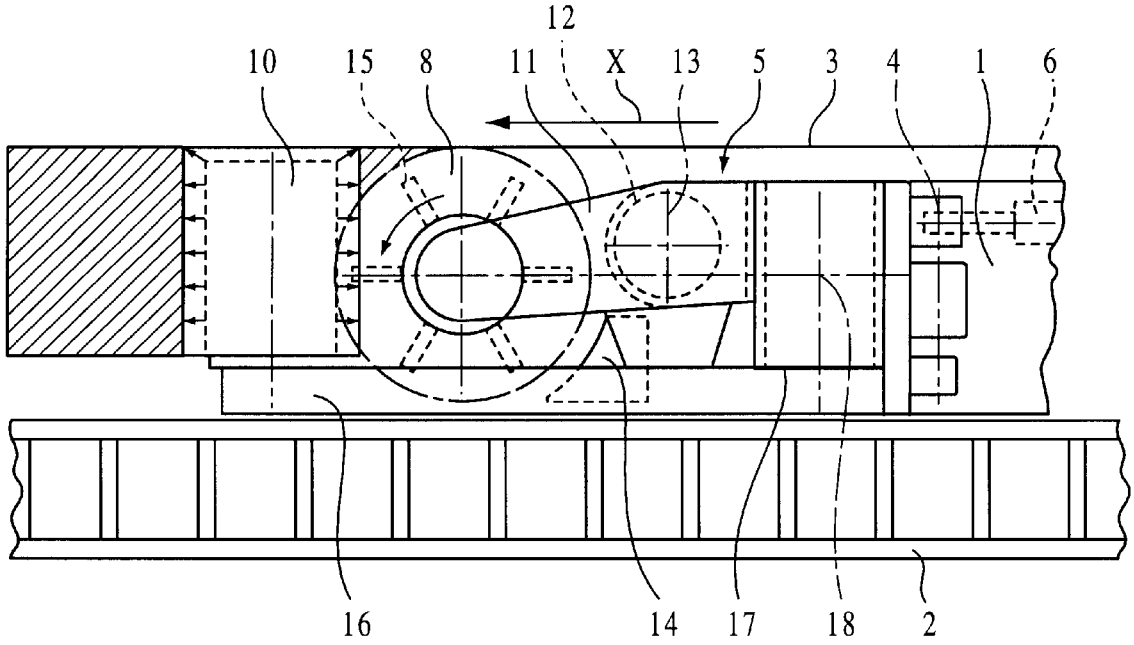
FIG. 1 is a schematic top view of a first embodiment of a longwall cutter and loader as defined by the invention.

Referring to FIGS. 1–4, the body 1 of the machine, shown only partially, is drivable along a longwall conveyor 2, which extends along the mining front 3 of a longwall. On machine body 1, a support construction 5 is pivotally-mounted, swinging about a joint 4 with a horizontal joint axle. A pressure medium cylinder 6 is provided for pivoting support construction 5 about joint 4.

Support construction 5 carries two cutting rollers fitted with cutting tools. One cutting roller has a rotary axle extending perpendicular to the sill 7, and is referred to hereinafter as the vertical roller 8. The other cutting roller has a horizontal rotary axle extending parallel to the roof 9, and is referred to hereinafter as the horizontal roller 10.

Horizontal roller 10 is arranged ahead of vertical roller 8, viewed in the direction of travel (arrow x), and serves for cutting free roof 9. Viewed in the direction of travel of the machine (arrow x), vertical roller 8 is arranged behind horizontal roller 10 and serves to cut free sill 7 as well as to transport the material cut loose by horizontal roller 10 onto longwall conveyor 2.

Figure 2:
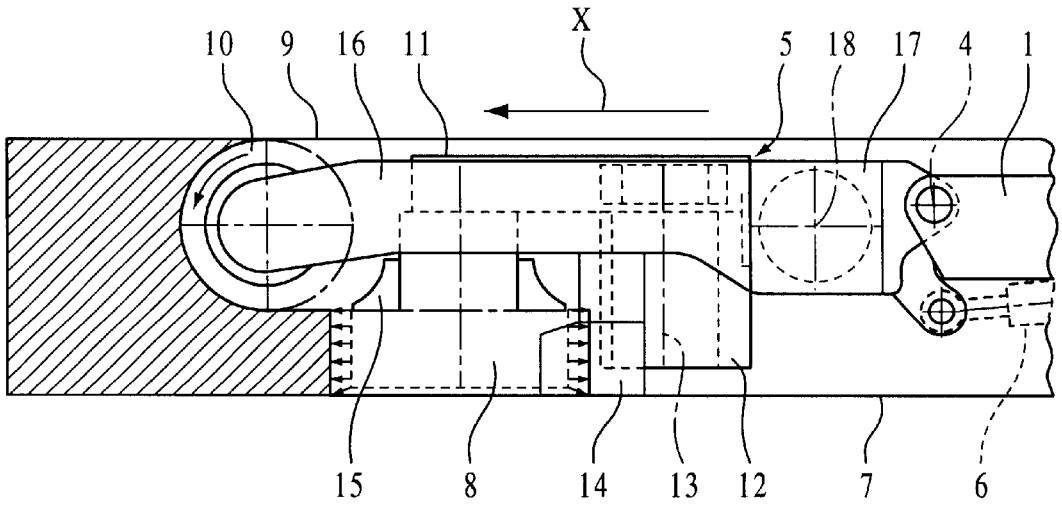
FIG. 2 is a side view of the machine shown in FIG. 1.

In the embodiment according to FIGS. 1 and 2, support construction 5, which can be pivoted as a whole, is inherently rigid. It has a rigid first support arm 11 extending over vertical roller 8, which is supported on the free end of arm 11. Furthermore, a housing 12 is supported on rigid support arm 11, the housing receiving a drive motor 13 for vertical roller 8. Drive motor 13 and vertical roller 8 are connected by a drivetrain (not shown) extending through arm 11.

A broaching plow 14 is mounted on the underside of rigid support arm 11 and, when necessary, pushes material left behind after vertical roller 8 onto longwall conveyor 2. Finally, vertical roller 8 is provided with radially extending driver bridges 15. Driver bridges 15 support the removal of material and its loading on longwall conveyor 2 when vertical roller 8 is rotating.

Furthermore, in the embodiment of FIGS. 1 and 2, support construction 5 has a second rigid support arm 16 extending laterally next to horizontal roller 10, which is supported on the free end of second arm 16. Moreover, rigid support arm 16 has a housing 17 receiving a drive motor 18 for the horizontal roller 10. Drive motor 18 and horizontal roller 10 are connected by a drive-train (not shown) extending through support arm 16.

In order to work on different seam thicknesses, horizontal roller 10 and vertical roller 8 can be mounted at different vertical levels with the help of auxiliary means (not shown). However, the cutting sections of the two cutting rollers complement or overlap each other so that in the course of a mining run, the entire thickness of the longwall is collected, from roof 9 down to sill 7.

FIGS. 1 and 2 show that horizontal roller 10, which is the leading roller in the direction of travel of the machine, first cuts free a top bank of the seam up to roof 9. The material cut loose is conveyed in this process into the operating range of vertical roller 8 by the rotation of horizontal roller 10. The trailing vertical roller 8 subsequently cuts free the lower bank of the seam down to sill 7 and conveys the cut material onto longwall conveyor 2 together with the material cut free by horizontal roller 10. The transverse transport of the material cut loose and free is supported by the radially extending broaching bridges 15 provided on vertical roller 8. Any material left behind is subsequently pushed onto longwall conveyor 2 by broaching plow 14.

Figure 3:
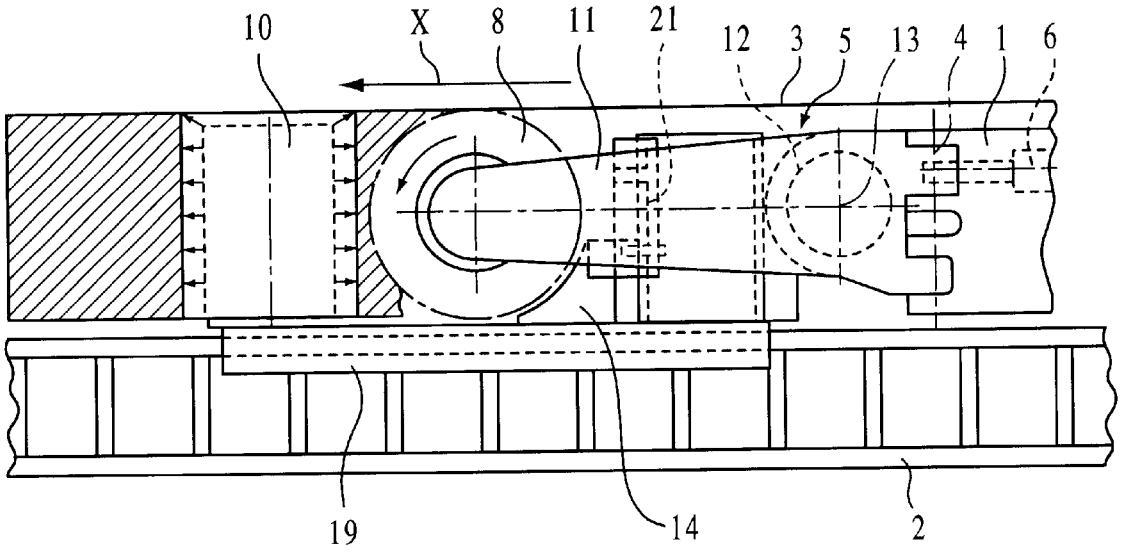
FIG.3 is a top view of a second embodiment of a longwall cutter and loader as defined by the invention.
Figure 4:
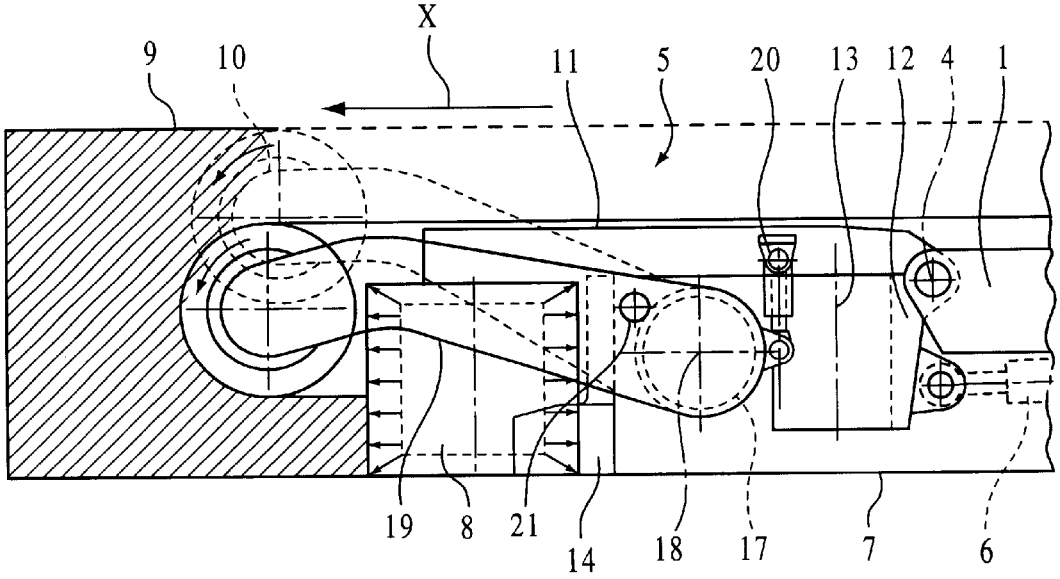
FIG. 4 is a side view of the machine shown in FIG. 3.

The longwall cutter and loader according to FIGS. 3 and 4 is identical with the embodiment of FIGS. 1 and 2 with respect to its important components. However, in the embodiment according to FIGS. 3 and 4, rigid support arm 16 supporting the horizontal roller 10 in the first embodiment is replaced by a movable support arm 19, which is pivotally-mounted on support arm 11 carrying vertical roller 8, swinging about a horizontal axle 21 by means of a pivoting cylinder 20. During the operation of the machine, it is possible to change the vertical position of horizontal roller 10 as shown in FIG. 4 by the dashed lines, and to thus adjust the machine in the course of its operation to different thicknesses of a seam. Apart from the embodiment of FIGS. 1 and 2, the entire support construction 5 can be adjusted relative to machine body 1 by means of pressure medium cylinder 6.

If need be, the axle of horizontal roller 10 may extend also at an angle, and inclined with respect to the surface being mined. In this case, it is possible to support horizontal roller 10 on two support arms 16 and 19. This variation is not shown in the drawing.

Finally, it is possible to make provision for a horizontal and vertical roller combination on each end of the machine for both directions of travel. Such an embodiment offers advantages on loop runs for producing a new break-in, and furthermore, it will permit the machine to work in each direction of travel through the longwall mining operation. This variation, too, is not shown in detail in the drawing.

While a few embodiments of the present invention have been shown and described, it is to be understood that many changes and modifications may be made thereunto without departing from the spirit and scope of the invention as defined in the appended claims.

What is claimed is:

1. A longwall coal cutter and loader for longwall mining operations of material in a longwall having a surface, a roof and a sill comprising:

(a) a longwall conveyor;

(b) a machine body drivable along the longwall conveyor in a mining drive direction longitudinal to the surface of the longwall;

(c) at least two cutting rollers having cooperating cutting sections comprising:

(i) a vertical roller for cutting free material from the sill, said vertical roller having a rotary axle extending perpendicular to the sill, and (ii) a horizontal roller for cutting free material from the roof, said horizontal roller having a rotary axle extending parallel to the roof, said horizontal roller being arranged above the vertical roller and ahead of said vertical roller in the direction of the mining drive.

2. The longwall coal cutter and loader according to claim 1, wherein each horizontal and vertical roller has a drive motor and gearing, said horizontal roller and said vertical roller and their drive motors and gearings being secured on a common support construction.

3. The longwall coal cutter and loader according to claim 2, wherein said horizontal roller and said vertical roller are fixable at different vertical levels in relation to said support construction.

4. The longwall coal cutter and loader according to claim 2, wherein said entire support construction is vertically adjustable with respect to said machine body.

5. The longwall coal cutter and loader according to claim 4, wherein said common support construction is pivotally-mounted on the machine body, swinging about a swivel axis extending perpendicular to the longwall surface.

6. The longwall coal cutter and loader according to claim 2, further comprising a support arm having a free end and wherein the horizontal roller is supported on the free end of said support arm extending in the direction of the mining drive, said support arm being pivotally-mounted on said common support construction.

7. The longwall coal cutter and loader according to claim 1, wherein said vertical roller has a roller body provided with radially extending driver bridges for transporting transversely the material cut loose by said horizontal roller.

8. The longwall coal cutter and loader according to claim 1, further comprising, a broaching plow disposed behind said vertical roller, said broaching plow pushing the material left behind after said vertical roller onto the longwall conveyor.

9. The longwall coal cutter and loader according to claim 1, wherein said machine body is drivable in two driving directions and a horizontal and vertical roller combination is provided at each end of the machine for both driving directions.

10. The longwall coal cutter and leader according to claim 1, wherein said horizontal roller has an axle extending at an angle inclined with respect to the surface being mined.

* * * * *

UNITED STATES PATENT AND TRADEMARK OFFICE

CERTIFICATE OF CORRECTION

PATENT NO. : 6,247,758 B1
DATED : June 19, 2001
INVENTOR(S) : Herbert Schüppaus

It is certified that error appears in the above-identified patent and that said Letters Patent is hereby corrected as shown below:

Title page,
Insert Item [30] Foreign Application Priority Data as follows:

-- June 16, 1999 (DE) ..... 199 27 364.2 --

Signed and Sealed this

Fourteenth Day of May, 2002

*Attest:*

*Attesting Officer*

JAMES E. ROGAN
*Director of the United States Patent and Trademark Office*